United States Patent [19]

Lo

[11] Patent Number: 4,953,850

[45] Date of Patent: Sep. 4, 1990

[54] WIND-DRAG TYPE EXERCISE BICYCLE WITH PEDALS DISPOSED IN FRONT OF THE SEAT THEREOF

[76] Inventor: Peter K. Lo, P.O. Box 13-124, Taipei, Taiwan

[21] Appl. No.: 413,119

[22] Filed: Sep. 27, 1989

[51] Int. Cl.[5] ..... A63B 21/00

[52] U.S. Cl. ..... 272/73; 272/130

[58] Field of Search ..... 272/72, 73, 128, 130, 272/93; 128/25 R

[56] References Cited

U.S. PATENT DOCUMENTS

| | | | |
|---|---|---|---|
| 4,582,318 | 4/1986 | Giannelli et al. | 272/73 |
| 4,705,269 | 11/1987 | DeBoer et al. | 272/73 |
| 4,770,411 | 9/1988 | Armstrong | 272/73 |
| 4,796,882 | 1/1989 | Jiumr | 272/73 |

*Primary Examiner*—Stephen R. Crow

[57] ABSTRACT

A wind-drag type exerciser bicycle includes a seat having a back, a drive assembly disposed in front of the seat, a wheel assembly having a wheel with a plurality of wheel blades in front of the drive assembly, and a driven shaft assembly interposed between the drive assembly and the wheel. A chain is trained on the driving sprocket of the drive assembly and the driven sprocket of the driven shaft assembly and is tensioned by a spring-biased tensioning sprocket. A V-belt is trained on the driving pulley of the driven shaft assembly and the driven pulley of the wheel assembly. A freewheel clutch is interposed between the driven sprocket and the driven shaft of the driven shaft assembly so that the wheel can rotate only when the pedals of the drive assembly are propelled forward by the user.

2 Claims, 4 Drawing Sheets

WIND-DRAG TYPE EXERCISE BICYCLE WITH PEDALS DISPOSED IN FRONT OF THE SEAT THEREOF

BACKGROUND OF THE INVENTION

This invention relates to an exercise bicycle, more particularly to an exercise bicycle which has pedals disposed in front of the seat thereof.

In my U.S. Pat. applications, Ser. Nos. 07/192,166, 07/298,692 and 07/343,593, (the former two having been patented under U.S. Pat. Nos. 4,824,102 and 4,852,872, the latter one having been granted but not yet patented), I disclosed wind-drag type exercise bicycles for exercising arms and legs, each of which has foot operated pedals positioned below the seat thereof. These exercise bicycles can offer an intense amount of exercise to the entire body of the user. Nowadays, however, it is sometimes necessary for those doing office work to effectively exercise their legs while keeping the upper parts of their bodies as relaxed as possible. Accordingly, the improvement of this invention is directed to the conventional exerciser bicycle shown in FIG. 1, which is used solely to exercise a user's legs via pedals positioned in front of the seat thereof. As illustrated, the conventional exercise bicycle includes a frame assembly 1, a drive assembly 2, a wheel assembly 3, a chain 4 and two side shields 5. The frame assembly 1 consists of a front frame portion 11 and a rear frame portion 12. The rear end of the front frame portion 11 is inserted into the front end of the rear frame portion 12 and is locked on the same by a locking bolt 13. When the bicycle is viewed from the top, the front frame portion 11 of the frame assembly 1 has a generally U-shaped front end portion which is constructed of two parallel arms 111. Each of the arms 111 has an open-ended slot 112 formed in the upper surface thereof. The front frame portion 11 includes a horizontal body, an inverted T-shaped support 113 extending downward from the horizontal body, and a support frame 114 extending upward from said horizontal body. A bearing means 115 is disposed on the support frame 114. An L-shaped plate 116 is secured to the support frame 114. The rear frame portion 12 includes an inclined rear end portion extending from the horizontal body thereof, and two handlebars 14 disposed on two sides of the seat 15 of the bicycle. The drive assembly 2 includes a driving shaft (not shown) journalled on the bearing means 115, a driving sprocket 20 sleeved rigidly on the driving shaft, two crank arms 21 respectively secured to two ends of said driving shaft, and two pedals 22 respectively secured to the crank arms 21. The wheel assembly 3 includes a wheel 32 made of cast iron, and a driven sprocket 33 connected coaxially to the wheel 32. The wheel 32 has an annular groove (not shown) formed in the circumferential surface thereof. A brake belt 33 is connected securely to the L-shaped plate 116 and is engaged with the groove of the wheel 32. An adjusting means 51 is disposed on one of the side shields 5 so as to enable the user to adjust the gripping force of the brake belt 33 on the wheel 32. The axle 35 of the wheel 32 is journalled within the slots 112 of the arms 111. The chain 4 is trained on the driving sprocket 20 and the driven sprocket 30. The utilization of the brake belt 33 on the exercise bicycle has the following disadvantages:

(1) Because the brake belt 33 tends to push both the wheel 32 and the driven sprocket 30 toward the driving sprocket 20, after the bicycle has been used for a long period, the chain 4 loosens on the driving sprocket 20 and the driven sprocket 30. As a result, the longer the period for which the bicycle is used, the more the noise resulting from the engagement between the chain 4 and the sprockets 20, 30, adding tension-creating noise to what should be a tension-releasing exercise.

(2) Because the gripping force of the brake belt 33 on the wheel 32 is adjustable, the engagement between the brake belt 33 and the wheel 32 also creates much noise after long-term use.

(3) The brake belt 33 must be replaced after it wears to a certain extent.

SUMMARY OF THE INVENTION

It is therefore the main object of this invention to provide a wind-drag type exercise bicycle which allows a user to exercise his/her legs in a quiet condition.

According to this invention, a wind-drag type exerciser bicycle includes a seat having a back, a drive assembly disposed in front of the seat, a wheel assembly having a wheel with a plurality of wheel blades positioned in front of the drive assembly, and a driven shaft assembly interposed between the drive assembly and the wheel. A chain is trained on the driving sprocket of the drive assembly and the driven sprocket of the driven shaft assembly, and is tensioned by means of a spring-biased tensioning sprocket. A V-belt is trained on the driving pulley of the driven shaft assembly and the driven pulley of the wheel assembly. A freewheel clutch is interposed between the driven sprocket and the driven shaft of the driven shaft assembly so that the wheel can rotate only when the pedals of the drive assembly are propelled forward. The higher the rotational speed of the pedals, the more air impedance to the rotation of the wheel blades. With the tensioning sprocket connected to the chain, the noise resulting from the engagement between the chain and the driving sprocket, and between the chain and the driven sprocket, is minimized.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 2:
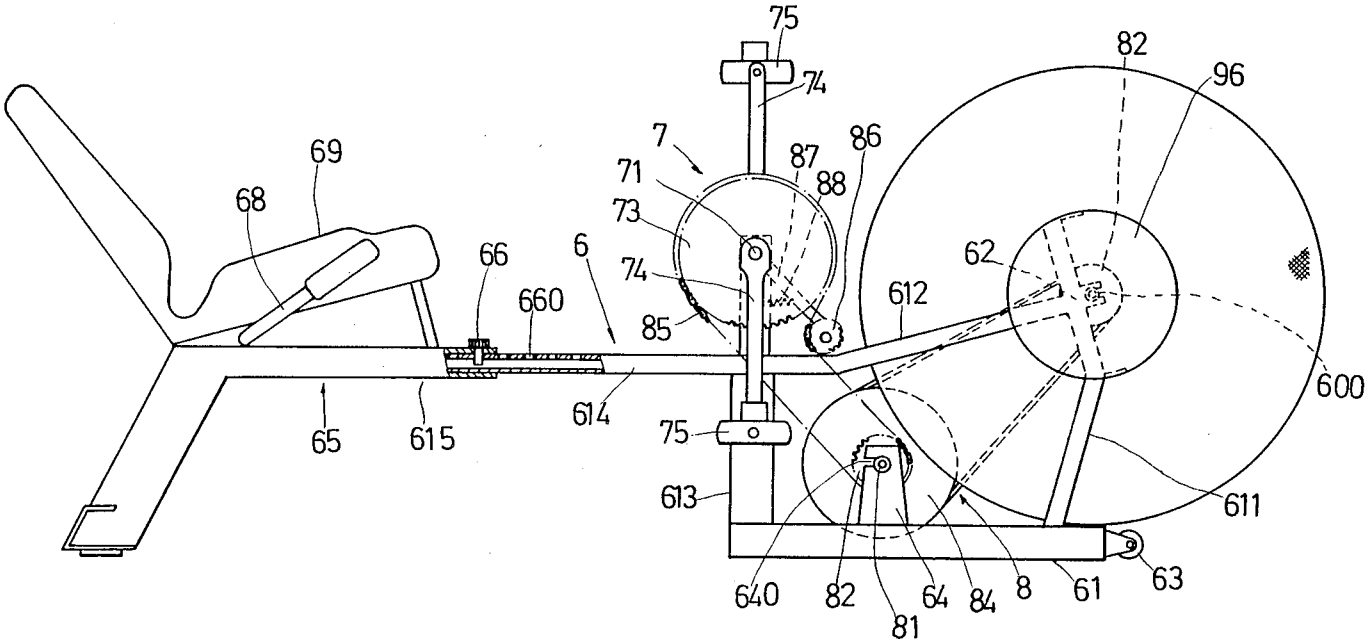
FIG. 2 is a schematic side view of a wind-drag type exercise bicycle according to this invention.
Figure 3:
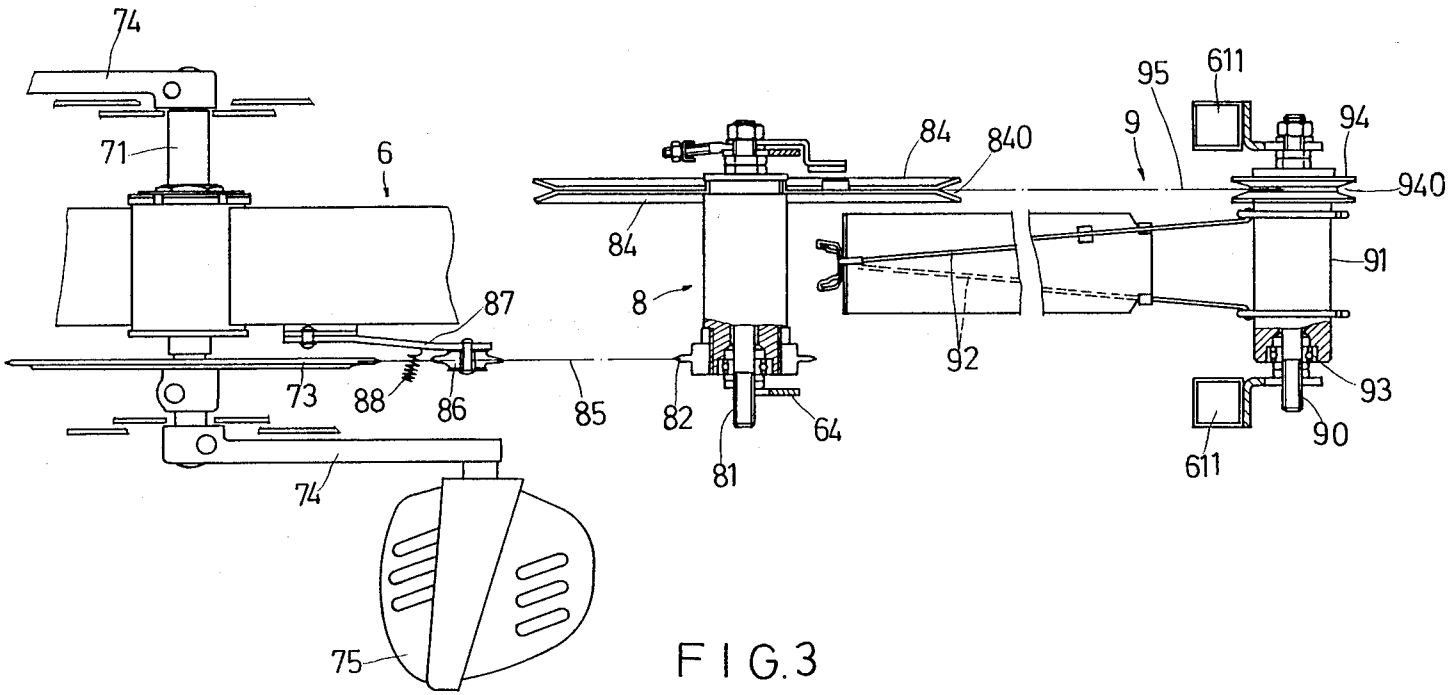
FIG. 3 is a schematic top view showing the wind-drag exercise bicycle of this invention.

Referring to FIGS. 2 and 3, a wind-drag type exercise bicycle of this invention includes a frame assembly 6, a drive assembly 7, a driven shaft assembly 8 and a wheel assembly 9.

The frame assembly 6 includes a rectangular base frame 61, a wheel frame 62 fixed on the front end portion of said base frame 61, two rollers 63 disposed at the front side of the base frame 61, a U-shaped bracket 64 fixed on the intermediate portion of said base frame 61, and a seat frame 65 disposed at the rear portion of the frame assembly 6. When the user desires to move the exercise bicycle, the rear portion of the exercise bicycle is raised manually so that the rollers 63 rest on the ground. Two handlebars 68 are fixed on the seat frame 64 on two sides of a seat 69 which has a back and which is also fixed on the seat frame 64. A pair of aligned front struts 611 support the wheel frame 62 on the base frame 61. The drive assembly 7 is supported on the base frame 61 by a support frame 613, which is connected securely to the wheel frame 62 by a reinforced rib 612. A horizontal tube 614 is secured to the support frame 613 and is inserted into the tubular front end portion 615 of the seat frame 65. Several threaded holes 660 are formed in the horizontal tube 614 so that a locking bolt 66 extends through the tubular front end portion 615 of the seat frame 65 to engage with a selected one of the threaded holes 660, thereby determining the distance between the drive assembly 7 and the seat 69.

The drive assembly 7 includes a driving shaft 71 journalled on the support frame 613, a driving sprocket 73 sleeved rigidly on the driving shaft 71, two crank arms 74 respectively secured to two ends of the driving shaft 71, and two pedals 75 respectively secured to the crank arms 74.

The driven shaft assembly 8 includes a driven shaft 81 extending through the open-ended slots 640 of the U-shaped bracket 64, a driven sprocket 82 sleeved rotatably on the driven shaft 81, a driving pulley 84 sleeved rigidly on said driven shaft 81, and a chain 85 trained on the driving sprocket 73 and the driven sprocket 82. A tensioning sprocket 86 is mounted rotatably on the frame assembly 6 by a connecting arm 87 and is biased by a spring 88 to tension the chain 85 so as to minimize the noise resulting from the engagement between the chain 85 and the driving sprocket 73, and between the chain 85 and the driven sprocket 82.

Figure 4:
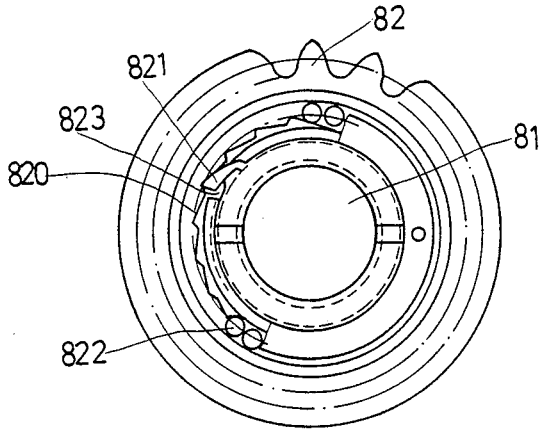
FIG. 4 is a schematic side view showing the freewheel clutch of the wind-drag type exercise bicycle according to this invention.
Figure 5:
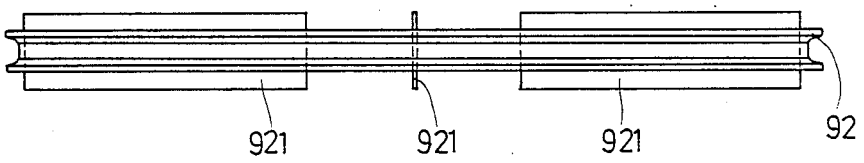
FIG. 5 is a schematic view showing the wheel blades of the wind-drag type exercise bicycle according to this invention.

Referring to FIG. 4, a freewheel clutch is provided between the driven sprocket 82 and the driven shaft 81. As illustrated, the driven sprocket 82 has ratchet teeth 820 provided on the inner surface thereof. A pawl element 821 is interposed between the ratchet teeth 820 of the driven sprocket 82 and the driven shaft 81 and is confined within the recess 823 of the driven shaft 81. A plurality of balls 822 are also interposed between the driven sprocket 82 and the driven shaft 81. When the driven sprocket 82 is rotated clockwise, one of the ratchet teeth 820 pushes both the pawl element 821 and the driven shaft 81 to rotate. On the other hand, in a situation where the driven sprocket 82 is rotated counterclockwise, the pawl element 821 slides over the ratchet teeth 820 and cannot rotate the driven shaft 81. Accordingly, the driven sprocket 82 can rotate the driven shaft 81 only When the pedals 75 are propelled forward.

Figure 1:
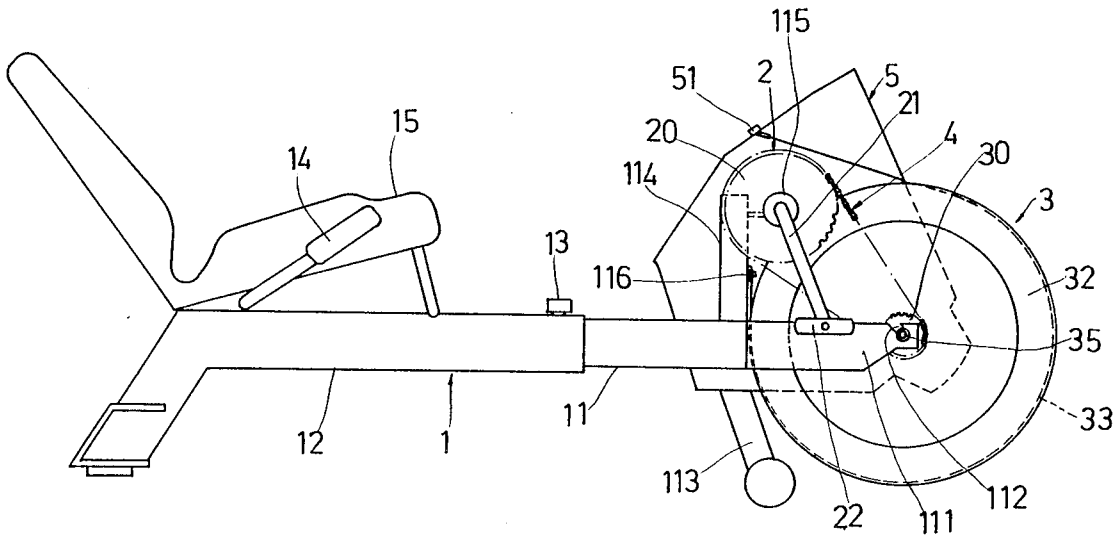
FIG. 1 PRIOR ART
FIG. 1 is a schematic side view of a conventional exercise bicycle.

Again referring to FIGS. 1 and 2, the wheel assembly 9 includes a wheel axle 90 extending through the open-ended slots 600 of the wheel frame 62, a hub 91 sleeved rotatably on the wheel axle 90, a wheel body 92 sleeved rigidly on the hub 91, two bearings 93 disposed on the wheel frame 62 so as to enable the wheel axle 90 to be journalled thereon, and a driven pulley 94 sleeved rigidly on said hub 91. A V-belt 95 is engaged with the V-shaped groove 840 of the driving pulley 84 and the V-shaped groove 940 of the driven pulley 94. The wheel body 92 is enclosed by a net shield (not shown) and has a plurality of radially extending wheel blades 921 which increase an resistance to the rotation of the wheel body 92. Two cylindrical covers 96 enclose respective ends of the hub 91.

With this invention thus explained, it is apparent that numerous modifications and variations can be made without departing from the scope and spirit of this invention. It is therefore intended that this invention be limited only as indicated in the appended claims.

I claim:

1. An exercise bicycle comprising:

a frame assembly adapted to rest on a horizontal surface;

a seat with a back fixed on a rear end portion of said frame assembly for positioning of a user thereon;

two handlebars fixed on said frame assembly at two sides of said seat so that the user can grip thereon;

a drive assembly including a driving shaft journalled on a middle portion of said frame assembly, a driving sprocket sleeved rigidly on said driving shaft, two crank arms respectively secured to two ends of said driving shaft, and two pedals respectively secured to said crank arms so that the user's feet can step thereon;

means for adjusting the distance between said seat and said drive assembly;

a wheel assembly including a wheel axle journalled on a front end portion of said frame assembly, a hub sleeved rigidly on said wheel axle, a wheel body sleeved rigidly on said hub, and a driven pulley sleeved rigidly on said hub, said wheel body having a plurality of generally radially extending wheel blades;

a driven shaft assembly including a driven shaft journalled on said frame assembly between said drive assembly and said wheel assembly, a driven sprocket sleeved rotatably on said driven shaft, a chain trained on said driving sprocket of said drive assembly and said driven sprocket of said driven shaft assembly, a freewheel clutch interposed between said driven sprocket and said driven shaft so as to lock said driven sprocket on said driven shaft when said pedals are rotated in one direction, a driving pulley sleeved rigidly on said driven shaft, and a V-belt trained on said driving pulley of said driven shaft assembly and said driven pulley of said wheel assembly; and a tensioning device connected to said chain so as to tension said chain;

whereby, rotation of said pedals can be transmitted to said driven shaft and subsequently to said wheel body.

2. An exercise bicycle as claimed in claim 1, wherein said tensioning device includes a tensioning sprocket mounted rotatably on said frame assembly, and a spring biasing said tensioning sprocket to tension said chain.

* * * * *